US006279589B1

(12) United States Patent
Goodley

(10) Patent No.: US 6,279,589 B1
(45) Date of Patent: Aug. 28, 2001

(54) CONTAINER CLEANING AND DISINFECTING APPARATUS UTILIZING OZONE

(75) Inventor: Mark D. Goodley, Escondido, CA (US)

(73) Assignee: AG Tech International, Inc., Escondido, CA (US)

( * ) Notice: Subject to any disclaimer, the term of this patent is extended or adjusted under 35 U.S.C. 154(b) by 0 days.

(21) Appl. No.: 09/399,435

(22) Filed: Sep. 20, 1999

(51) Int. Cl.[7] ..... B08B 9/093

(52) U.S. Cl. ..... 134/102.1; 134/168 R; 239/146; 239/722

(58) Field of Search ..... 134/102.1, 102.2, 134/167 R, 168 R; 239/146, 195, 197, 722; 422/186.12

(56) References Cited

U.S. PATENT DOCUMENTS

| | | | | |
|---|---|---|---|---|
| 2,923,954 | | 2/1960 | Babcock | 15/1.7 |
| 2,941,223 | | 6/1960 | Klauer | 15/79 |
| 3,326,468 | | 6/1967 | Bristow et al. | 239/227 |
| 3,434,882 | * | 3/1969 | Carolin | 134/102.1 X |
| 3,461,889 | | 8/1969 | Saxonmeyer | 134/43 |
| 3,477,178 | | 11/1969 | Hulbert, Jr. | 51/8 |
| 3,534,746 | * | 10/1970 | Posner | 134/167 R X |
| 3,830,430 | | 8/1974 | Hartunian | 239/186 |
| 3,897,263 | | 7/1975 | Davis et al. | 134/45 |
| 3,961,983 | | 6/1976 | Crandall et al. | 134/8 |
| 3,973,988 | | 8/1976 | McMahan | 134/46 |
| 3,985,572 | | 10/1976 | Petermann et al. | 134/34 |
| 4,106,516 | | 8/1978 | Wiegand | 134/45 |
| 4,141,374 | | 2/1979 | McMahan | 134/46 |
| 4,163,301 | | 8/1979 | Griffin | 15/50 R |
| 4,167,950 | | 9/1979 | Schaefer et al. | 134/52 |
| 4,240,175 | | 12/1980 | Rogers | 15/21 E |
| 4,309,788 | | 1/1982 | Brager et al. | 15/53 A |
| 4,363,687 | | 12/1982 | Anderson | 156/245 |
| 4,455,965 | | 6/1984 | Jung et al. | 118/622 |
| 4,615,487 | | 10/1986 | O'Brien et al. | 239/281 |
| 4,784,166 | | 11/1988 | Brager et al. | 134/50 |
| 4,817,653 | | 4/1989 | Krajicek et al. | 134/168 R |
| 4,835,811 | | 6/1989 | Crowhurst | 15/21 E |
| 4,901,985 | | 2/1990 | Soofi | 266/281 |
| 5,004,156 | | 4/1991 | Montanier | 239/130 |
| 5,310,302 | | 5/1994 | Ferguson, Sr. | 414/424 |
| 5,622,319 | * | 4/1997 | Babb et al. | 239/722 |
| 5,803,982 | | 9/1998 | Kosofsky et al. | 134/10 |
| 5,853,014 | * | 12/1998 | Rossenauer | 134/102.1 |

* cited by examiner

*Primary Examiner*—Philip R. Coe
(74) *Attorney, Agent, or Firm*—Koppel & Jacobs; Michael J. Ram

(57) ABSTRACT

An apparatus for cleaning and disinfecting containers, such as elongated, walled containers, such as truck trailers, rail cars, airplane holds, or ship containers, generally comprises a rolling trolley which produces a disinfecting mixture of ozone and water at high pressure and delivers the disinfectant by a hose to a rolling dolly which enters into the container. The trolley supports the dolly at a height conductive for entry into the container. The dolly is manually pushed into the container. Rotating spray nozzles on the dolly deliver the disinfectant at high pressure to the inside walls of the container. The nozzles are directed at an angle fore or aft of their radius of rotation such that the spray strikes the wall of the container at a sheer angle. Hose retrieval apparatus on the trolley retrieves the hose so as to pull the dolly from the container at a desired speed, thereby controlling the cleaning/disinfecting rate. The trolley includes either a water source, an ozone generator, a venturi for combining the generated ozone with the water, a holding tank for containing the combined water and ozone, a recirculating system for recirculating the combined water and ozone from the holding tank through the venturi for increasing the ozone concentration, and a high pressure pump for delivering at high pressure the combined water and ozone from the holding tank to the hose to the dolly.

22 Claims, 2 Drawing Sheets

CONTAINER CLEANING AND DISINFECTING APPARATUS UTILIZING OZONE

FIELD OF THE INVENTION

This invention relates to an apparatus for cleaning and disinfecting containers, particularly elongated, walled containers, such as a truck trailers, rail cars, airplane holds, or ship containers; and more specifically to an apparatus utilizing a cleaning/disinfecting of ozone combined with water.

BACKGROUND OF THE INVENTION

Containers, such as truck trailers, rail cars, airplane holds, or ship containers, often become contaminated during use and have to be disinfected.

Various cleaning devices have been devised for washing and/or scrubbing out the interior of the containers, and chemicals have been used to disinfect the containers. One problem with the prior art methods of cleaning is that the discharge from the container still contains contaminant that is environmentally undesirable and needs to be further dealt with for disposal.

One problem with prior art methods of disinfecting a container with chemicals is that the discharge from the container includes the chemicals which then must be dealt with and adequately disposed. Chemicals must be bought, transported, stored and disposed.

Another problem with some prior art devices is that there is no reproducible cleaning protocol, that is no manner is provided for assuring that the same degree of cleaning is repeatable.

Therefore there has been a need for an apparatus that cleans and disinfects a container without leaving any chemicals in the residue.

It is further desirable that such an apparatus be completely self-contained or require only a source of water.

It is further desirable that the cleaning protocols, such as disinfectant composition, rate of discharge, discharge pressure, and rate of area coverage, be repeatable.

SUMMARY OF THE INVENTION

The invention is an apparatus for cleaning and disinfecting containers, such as elongated, walled containers, such as truck trailers, rail cars, airplane holds, or ship containers. A preferred embodiment of the apparatus generally comprises a rolling trolley which produces a disinfecting mixture of ozone and water at high pressure and delivers the disinfectant by a hose to a rolling dolly which enters into the container. The trolley supports the dolly at a height conductive for entry into the container. The dolly is manually pushed into the container.

Rotating spray nozzles on the dolly deliver the disinfectant at high pressure to the inside walls of the container. The nozzles are directed at an angle fore or aft of their radius of rotation such that the spray strikes the wall of the container at a sheer angle. The dolly includes various adjustment mechanisms for providing that the spray nozzles move at a desired distance from the walls of the container.

The trolley includes a hose retrieval apparatus for retrieving the hose so as to pull the dolly from the container at a desired speed and thereby controlling the cleaning/disinfecting rate. The trolley includes either a water tank holding water sufficient for cleaning the container or means for connecting to a water source, an ozone generator, a venturi for combining the generated ozone with the water, a holding tank for containing the combined water and ozone, a recirculating system for recirculating the combined water and ozone from the holding tank through the venturi for increasing the ozone concentration, and a high pressure pump for delivering at high pressure the combined water and ozone from the holding tank to the hose to the dolly.

Other features and many attendant advantages of the invention will become more apparent upon a reading of the following detailed description together with the drawings wherein like reference numerals refer to like parts throughout.

DETAILED DESCRIPTION OF THE INVENTION

Figure 1:
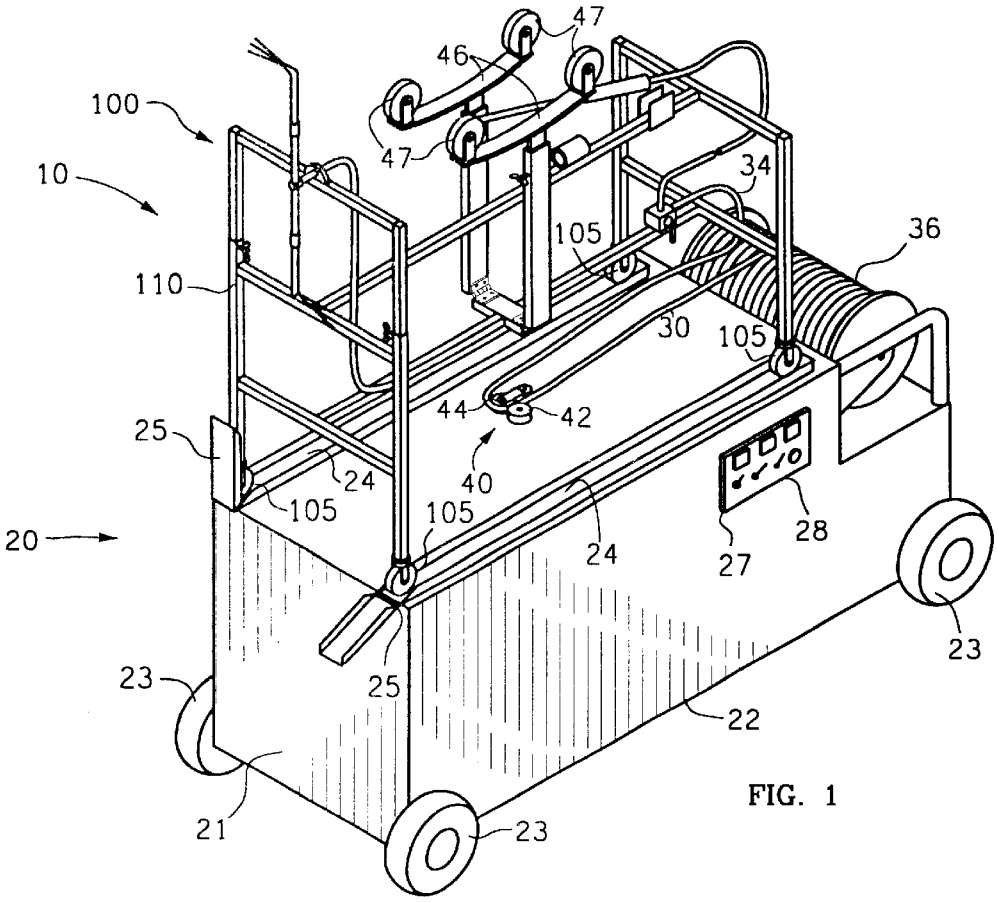
FIG. 1 is a perspective view of a preferred embodiment of the self-contained container cleaning and disinfecting apparatus of the invention.

With reference now to the drawings, FIG. 1 is a perspective view of a preferred embodiment of the self-contained container cleaning and disinfecting apparatus 10 of the invention. Although apparatus 10 will disinfect a variety of containers, the preferred embodiment shown is specifically designed for cleaning and disinfecting an elongated, walled container, such as a truck trailer, rail car, airplane hold, or ship container.

Disinfecting apparatus 10 includes a trolley 20, and a dolly 100. Trolley 20 includes a frame 22 rollingly supported by wheels 23. Dolly support means, such as a pair of channels 24, support dolly 100 at a height conductive for entry into a truck trailer. A pair of ramps 25, hingedly connected to the front end of channels 24, swing from an upward position wherein they retain dolly 100 in channels 24 to a downward position for deploying dolly 100. In this regard, ramps 25 would commonly bridge between trolley 20 and the floor of a truck trailer. A hose 30, shown with its major portion wound in a storage position on reel 36, has an outer end, such as second end 34, connected to dolly 100. Hose retrieval means is provided for retrieving un-reeled hose, and hence extracting dolly 100 from a container, at a desired rate. In the preferred embodiment, engagement means 40, such as friction wheel 42 and opposed pressure rollers 44, are engageable with hose 30 such that rotation of friction wheel 42 retrieves hose 30. Control means 27, such as control panel 28 including a computer and keys and switches, is connected to the internal elements of trolley 20 for controlling them.

Figure 2:
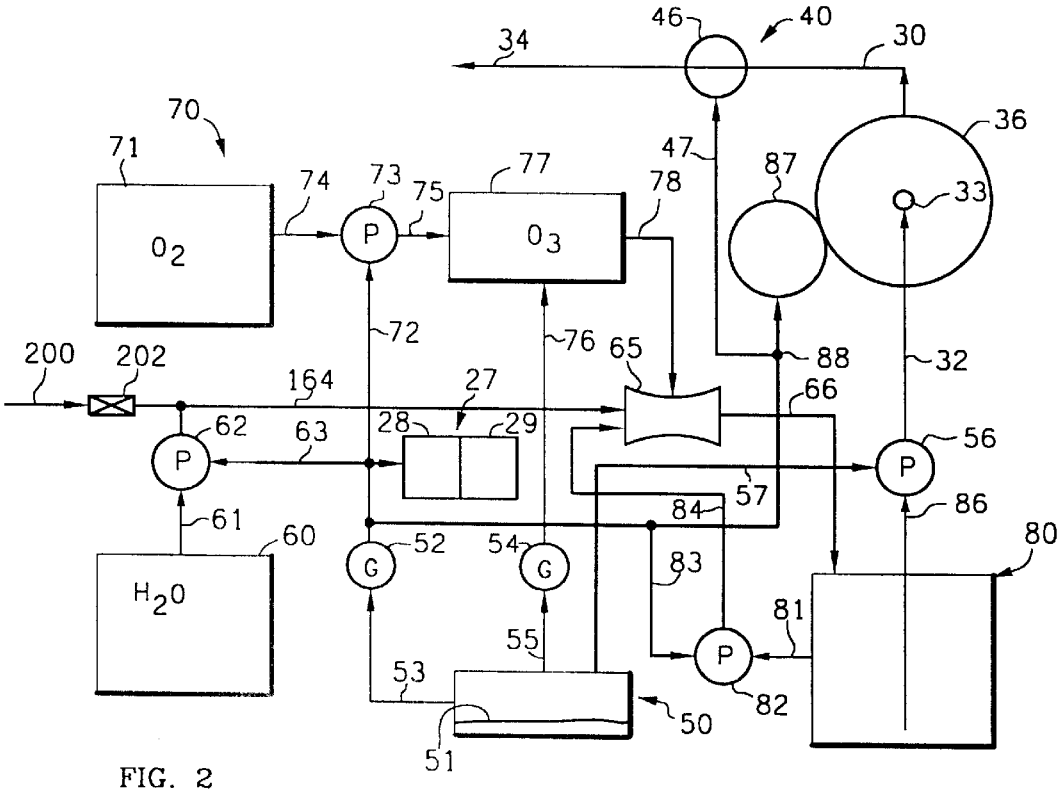
FIG. 2 is a diagram of elements of the trolley.

FIG. 2 is a diagram of other elements of trolley 20. A power source, such as an internal combustion engine, such as a low pollution engine, such as a CNG engine or LP engine 50, includes its own fuel source, such as gas tank 51. Engine 50 mechanically powers a low voltage generator, such as 110-240 volt generator 52 by means, such as a pulley, represented as connection 53. Engine 50 mechanically powers a high voltage generator, such as a 4k-10k volt generator 54 by means, such as by pulley 55. Engine 50 mechanically powers a high pressure pump 56 by means such as pulley 57.

Trolley 20 may be connected to a water source, such as to a water supply hose 200, by valve 202, but, preferably, trolley 20 includes its own source of water, such as water storage tank 60 for providing sufficient water for disinfecting the container. Disinfecting a large truck trailer typically requires a water storage tank of about 50 gallons. A pump 62, powered by low voltage generator 52 via line 63, receives water via conduit 61 from storage tank 60 and pumps it via conduit 64 to combining means, such as venturi 65, for combining the water with ozone.

Means 70 for creating ozone generally includes an oxygen source 71, a pump 73, and an ozone generator 77. Oxygen source 71, such as an ambient air dryer or oxygen concentrator, as are well-known in the art, provides oxygen for making ozone. Pump 73 moves the gas containing air through the means for making ozone. As shown, pump 73, powered by line 72 from low voltage generator 52, receives gas including oxygen from oxygen source 71 in conduit 74 and moves it via conduit 75 to ozone generator 77. Of course, pump 73 may be before or after the other elements 71,77. Ozone generator 77 receives the gas including oxygen from source 71 and receives a high frequency alternating voltage from high voltage generator 54 on line 76 to generate ozone by corona discharge, as is well-known. The gas containing ozone exits ozone generator 77 via conduit 78 and combines with the water in venturi 65. The ozone/water mixture leaves venturi 65 via conduit 66 and is held in mixing or holding tank 80 becoming a disinfectant. In holding tank 80, the ozone combines with the water to form hydroxyl radicals and peroxide. Various catalysts can be added to the disinfectant to increase the amount of the above reactions.

The disinfectant in holding tank 80 is recirculated through venturi 65 to raise the ozone levels. A low-pressure recirculating pump 82, powered by line 83 from low voltage generator 52, receives disinfectant via conduit 81 from holding tank 80 and pumps it via conduit 84 into venturi 65 where it receives more ozone.

High pressure pump 56 receives disinfectant via conduit 86 from holding tank 80 and delivers it at high pressure to first end 32 of hose 30. Preferably, high pressure pump 56 produces a high pressure in the range of 600 to 3000 psi at a flow rate of 5 to 25 gallons per minute. A rotating coupling 33 feeds hose 30 into the center of reel 36 upon which most of the hose 30 is wound when in the storage position.

In the preferred embodiment, biasing motor 87, powered by low voltage generator 52 via line 88, is selectively connected to reel 36 so that reel 36 may reel in slack hose 30 or may freely reel out hose 30.

Means 40 is provided for retracting hose 30 at a desired rate. As discussed with respect to FIG. 1 above, retraction means 40 includes a friction wheel 42 and pressure rollers 44. Friction wheel 42 may be powered by a motor, such as a stepper motor or variable speed motor 46 powered via line 47 by low voltage generator 52. Alternatively, motor 87 may be used to turn reel 36 to reel in hose 30 at a selected rate.

Control means 27 includes a control panel 28 including a computer 29 connected (not shown) by means well-known to the other components for controlling the operations of the other components.

Returning to FIG. 1, dolly 100 is shown in storage position atop trolley 20. Dolly 100 generally includes a chassis 110 rollingly supported by wheels 105. Wheels 105 are disposed in channels 24. In typical use, trolley 20 is moved to place front end 21 facing the entry of a container, such as a truck trailer. Ramps 25 are lowered and placed on the floor of the trailer, and dolly 100 is manually pushed off trolley 20, over ramps 25, and into the trailer. Reel 36 freely feeds out hose 30.

Figure 3:
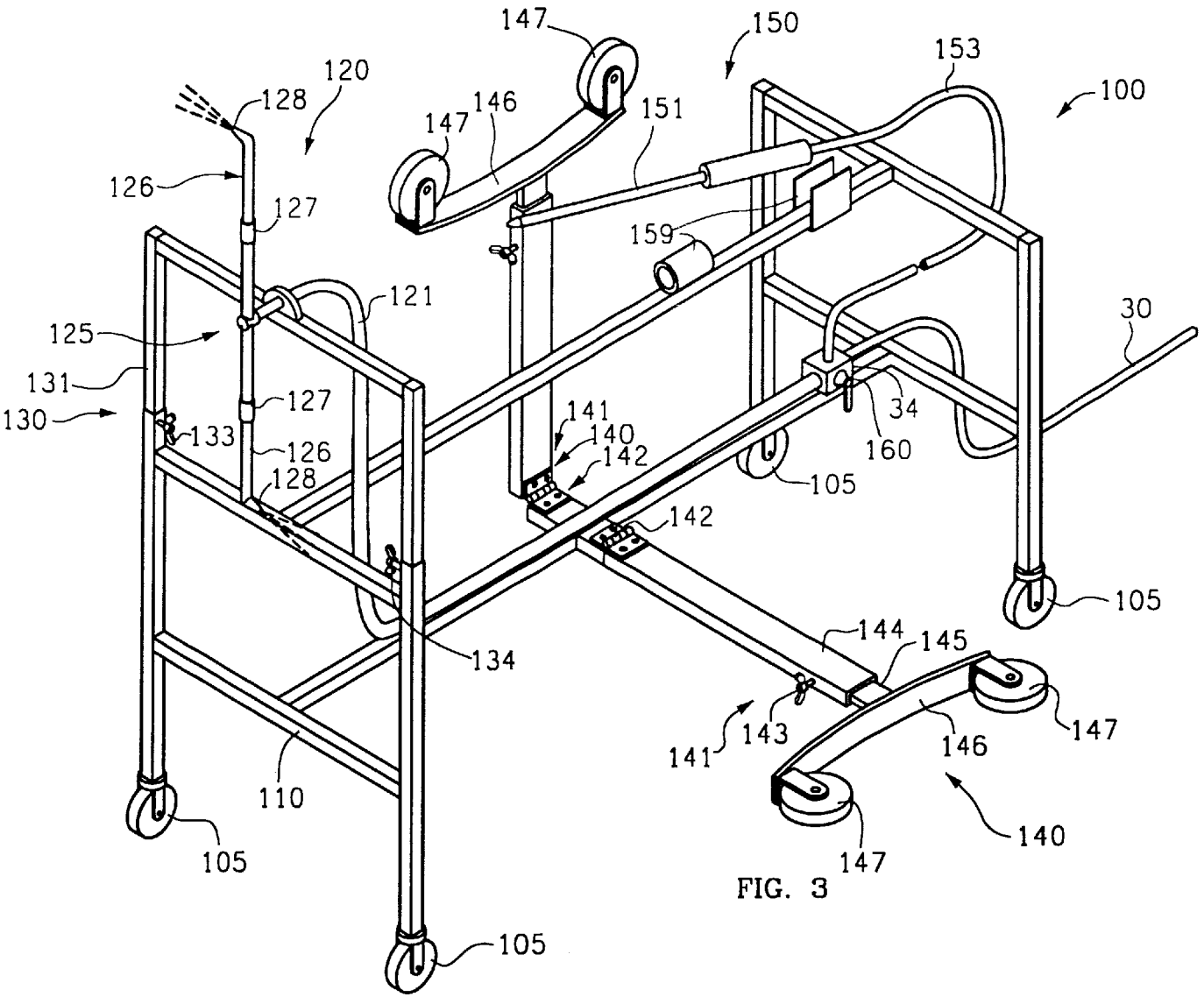
FIG. 3 is an enlarged partial perspective view of the spray dolly of FIG. 1.

FIG. 3 is an enlarged partial perspective view of the spray dolly 100 of FIG. 1. Spray means 120 includes a hose 121 connected by valve 160 for selectively receiving at high pressure the combined water and ozone from hose 30, and a nozzle head 125 and adapted for directing a stream of the disinfectant around the interior of the container. Nozzle head 125 is rotatingly mounted to chassis 110 and includes a plurality of radial arms, such as two arms 126. Each arm 126 includes a distal nozzle 128 directed at an angle to the radial such that ejected disinfectant causes nozzle head 125 to rotate. Preferably also, nozzles 128 are directed at a slight angle fore or aft of their radius of rotation, preferably at approximately five degrees frontally, such that the spray strikes the wall of the container at a sheer angle. This has been found to better dislodge contaminant. Preferably, each arm 126 includes means, such as being telescopically adjustable including sleeve clamp 127, for varying the length of the arm 126 such that its nozzle 128 is close to the container wall during the rotation of arm 126.

Height adjustment means 130 is provided for selectively supporting spray means 125 at a desired height. The selected height would typically center the spray nozzles 128 between the floor and ceiling of the container. Height adjustment means 130 includes a pair of telescoping members 131,132 of chassis 110, and means, such as hand operable set screws 133, 134 for locking telescoping members 131, 132 respectively, at the desired height.

Wall guide means 140, such a pair of guide arms 141 (one shown partially cut away for drawing clarity), engages the sides of the container for maintaining dolly 100 in a desired orientation for travel relative to the sides of the container being cleaned. Each guide arm 141 includes proximal 144 and distal 145 telescoping members, and means, such as hand operable set screw 143, for adjusting the length of arm 141. Compliant means, such as leaf spring 146, supports container side wall contact means, such as a pair of wheels 147, for maintaining dolly 100 at a relatively fixed distance relative to the container wall while providing allowance for slight variations in linearity of the wall. Other compliant means could be used, such as springs outwardly biasing each wheel or having outwardly biased spring loaded telescoping members 144, 145. Typically, wall guide means 140 would be adjusted such that spray nozzles 128, during their rotation, are equidistant from the container sides. Preferably, guide arm 141 is hingedly connected, such as by hinge 142, to chassis 110, such that guide arms 141 may be swung to an upright position when not in use as seen in FIG. 1.

Manually directed spray means 150, such a spray gun 151, is attached to chassis 110 by suitable means, such as holster 159, for providing a manually directed spray for cleaning the front and rear walls of the container and for cleaning particularly contaminated areas. Gun 151 includes a hose 153 connected by valve 160 to outer end 34 of hose 30 for selectively receiving high pressure combined water and ozone from hose 30.

Dolly 100 is very easily maneuvered manually by a person because it is relatively light because it contains only the essential elements for directing the disinfectant spray.

Because the cleaning/disinfecting used is a combination of ozone and water, no harmful chemicals are added to the residue from the container. Ozone ($O_3$), an allotropic form of oxygen, is a powerful oxidant. Ozone effectively kills bacteria by breaking up their molecular structure, inhibits fungal growth, and inactivates many viruses, cysts, and spores. In addition, soaps, oils, and chloramines can be rendered environmentally safe by ozone treatment. Ozone combines with the water to form hydroxyl radicals and peroxide, thus sterilizing the water. Because ozone is unstable, the ozone decomposes to oxygen leaving no residues to further eliminate. Ozone has a half-life of about 22 minutes at ambient temperatures. Consequently, for most cleaning/disinfecting operations, the residue only contains dead biological matter and water after a short period of time.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover the appended claims such modifications as come within the true spirit and scope of the invention.

I claim:

1. Apparatus for cleaning and disinfecting a container comprising:

a dolly for entry into the container comprising:

a chassis rollingly supported by wheels;

spray means supported by said chassis for receiving at high pressure combined water and ozone and adapted for directing a stream thereof around the interior of the container; and a trolley including:

a hose having:

a first end; and a second end connected to said spray means;

means for generating ozone;

means for combining the generated ozone with water from a water source;

a holding tank for containing the combined water and ozone; and a high pressure pump for delivering at high pressure the combined water and ozone from said holding tank to said first end of said hose.

2. The apparatus of claim 1 wherein said spray means includes a nozzle head, rotatingly mounted to said chassis, including a plurality of radial spray arms.

3. The apparatus of claim 2 wherein each said arm includes a distal nozzle directed at an angle fore or aft of their radius of rotation such that the spray strikes the wall of the container at a sheer angle.

4. The apparatus of claim 2 including means for selectively varying the length of said spray arms.

5. The apparatus of claim 2 wherein each said arm includes a distal nozzle directed at an angle to the radial such that ejected disinfectant causes said nozzle to rotate.

6. The apparatus of claim 5 wherein each said nozzle is directed at an angle fore or aft of its radius of rotation such that the spray strikes the wall of the container at a sheer angle.

7. The apparatus of claim 1 wherein said chassis includes height adjustment means for selectively supporting said spray means at a desired height.

8. The apparatus of claim 1 further including a pair of guide arms connected to said chassis including container side wall contacts for engaging the sides of the container being cleaned for maintaining said dolly in a desired orientation for travel relative to the sides of the container.

9. The apparatus of claim 8 wherein each said guide arm is variable in length.

10. The apparatus of claim 8 wherein each said guide arm includes compliant means supporting said side wall contacts for maintaining said dolly at a relatively fixed distance relative to the container wall while providing allowance for slight variations in linearity of the wall.

11. The apparatus of claim 8 wherein said guide arms are hingedly connected to said chassis such that they can be swung to an upright storage position.

12. The apparatus of claim 1 further including manually directable spray means connected to said hose 30 for receiving high pressure combined water and ozone from said hose.

13. The apparatus of claim 1 wherein said trolley further includes:

a frame including:

dolly support means for supporting said dolly at a height conductive for entry into the container.

14. The apparatus of claim 1 wherein said trolley further includes a frame rollingly supported by wheels.

15. The apparatus of claim 14 wherein said frame further includes:

dolly support means for supporting said dolly at a height conducive for entry into the container.

16. Apparatus for cleaning and disinfecting a container comprising:

a dolly for entry into the container comprising:

a chassis rollingly supported by wheels;

spray means supported by said chassis for receiving at high pressure combined water and ozone and adapted for directing a stream thereof around the interior of the container; and a trolley including:

a hose having:

a first end; and a second end connected to said spray means;

retrieval means for retrieving said hose as said dolly is extracted from the container;

means for generating ozone;

means for combining the generated ozone with water from a water source;

a holding tank for containing the combined water and ozone; and a high pressure pump for delivering at high pressure the combined water and ozone from said holding tank to said first end of said hose.

17. The apparatus of claim 16 wherein said retrieval means retrieves said hose at a desired rate and thereby extracts said dolly from the container.

18. The apparatus of claim 16 further including:

a reel for storing said hose; and wherein said retrieval means includes means for rotating said reel such that said hose will wind on said reel and pull said dolly from the container at a desired rate.

19. The apparatus of claim 16 wherein said retrieval means includes:

engagement means adapted to frictionally engage said hose for moving said hose so as to pull said dolly from the container at a desired speed.

20. A self-contained apparatus for cleaning and disinfecting a container comprising:

a dolly for entry into the container comprising:

a chassis rollingly supported by wheels;

spray means supported by said chassis for receiving at high pressure combined water and ozone adapted for directing a stream thereof around the interior of the container; and a trolley including:

a hose having:

a first end; and a second end connected to said spray means;

a water tank holding water;

means for generating ozone;

means for combining the generated ozone with water from said water tank;

a holding tank for containing the combined water and ozone; and a high pressure pump for delivering at high pressure the combined water and ozone from said holding tank to said first end of said hose.

21. The self-contained apparatus of claim 19 wherein said trolley further includes:

retrieval means for retrieving said hose as said dolly is extracted from the container.

22. The self-contained apparatus of claim 21 wherein said retrieval means retrieves said hose at a desired rate and thereby extracts said dolly from the container.

* * * * *